US010107041B2

(12) United States Patent
Herman et al.

(10) Patent No.: US 10,107,041 B2
(45) Date of Patent: Oct. 23, 2018

(54) DRILL BIT HAVING SHEAR CUTTERS AND GOUGING CUTTERS

(71) Applicant: Shear Bits, Ltd., Calgary (CA)

(72) Inventors: John James Herman, Cypress County (CA); Dallas Wilkins, Calgary (CA); Ryan J. C. Marley, Airdrie (CA); Timothy P. Beaton, Calgary (CA)

(73) Assignee: Shear Bits, Ltd., Calgary, AB (CA)

( * ) Notice: Subject to any disclaimer, the term of this patent is extended or adjusted under 35 U.S.C. 154(b) by 227 days.

(21) Appl. No.: 15/064,241

(22) Filed: Mar. 8, 2016

(65) Prior Publication Data

US 2016/0186498 A1 Jun. 30, 2016

Related U.S. Application Data

(63) Continuation of application No. 14/018,339, filed on Sep. 4, 2013, now abandoned.

(51) Int. Cl.

| | |
|---|---|
| ***E21B 10/43*** | (2006.01) |
| ***E21B 10/55*** | (2006.01) |
| ***E21B 10/54*** | (2006.01) |
| *E21B 10/42* | (2006.01) |

(52) U.S. Cl.

CPC ..... *E21B 10/43* (2013.01); *E21B 10/54* (2013.01); *E21B 10/55* (2013.01); *E21B 2010/425* (2013.01)

(58) Field of Classification Search

CPC ..... E21B 10/43

See application file for complete search history.

(56) References Cited

U.S. PATENT DOCUMENTS

| | | | | |
|---|---|---|---|---|
| 3,830,321 | A * | 8/1974 | McKenry | E21B 10/02 175/332 |
| 4,604,106 | A * | 8/1986 | Hall | B01J 3/062 175/434 |
| 4,942,933 | A * | 7/1990 | Barr | E21B 10/43 175/431 |
| 8,505,634 | B2 | 8/2013 | Lyons et al. | |
| 2008/0029312 | A1* | 2/2008 | Hall | E21B 10/43 175/429 |
| 2008/0035387 | A1 | 2/2008 | Hall et al. | |
| 2012/0279785 | A1 | 11/2012 | Gavia et al. | |

OTHER PUBLICATIONS

Extended European Search Report of EP14842632.3, dated Mar. 23, 2017.

* cited by examiner

*Primary Examiner* — Shane Bomar
*Assistant Examiner* — Steven A MacDonald
(74) *Attorney, Agent, or Firm* — Richard A. Fagin

(57) ABSTRACT

A drill bit includes a bit body defining a plurality of blades extending from a selected distance from an axis of rotation of the bit body to a gage face. A plurality of only gouging cutters is mounted on the bit body. At least one of the plurality of blades has a blade top surface longitudinally behind the tips of the gouging cutters at a selected distance from the tips of the gouging cutters.

26 Claims, 7 Drawing Sheets

DRILL BIT HAVING SHEAR CUTTERS AND GOUGING CUTTERS

CROSS-REFERENCE TO RELATED APPLICATIONS

Continuation of U.S. patent application Ser. No. 14/018,339 filed on Sep. 4, 2013

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND

This disclosure relates generally to the field of fixed cutter drill bits. More specifically, the disclosure relates to drill bits having both shear cutters and "gouging" type cutters.

Fixed cutter bits known in the art include PDC bits, wherein a plurality of PDC cutters are affixed to a bit body in a selected arrangement on one or more blades formed in the bit body.

Gouging type cutters are used in drill bits for drilling mine shafts or tunnels, among other uses. Such bits are known in the art as "claw" bits, one example of which is sold under the trademark QUI-KLAW, which is a trademark of Drillhead, Inc. Such bits are known to be useful in drilling clay, unconsolidated sand, loose rock and gravel.

U.S. Pat. No. 8,505,634 issued to Lyons et al. describes a drill bit having gouging cutting elements disposed adjacent to shearing cutting elements on a blade on the bit body. The shearing cutting elements have a planar cutting face, while the gouging cutting elements have a non-planar cutting face, e.g., dome shaped or cone shaped.

SUMMARY

A drill bit according to one aspect of the disclosure includes a bit body defining a plurality of blades extending from a selected distance from an axis of rotation of the bit body to a gage face. A plurality of only gouging cutters is mounted on the bit body. At least one of the plurality of blades has a blade top surface longitudinally behind the tips of the gouging cutters at a selected distance from the tips of the gouging cutters.

Other aspects and advantages will be apparent from the description and claims that follow.

DETAILED DESCRIPTION

Figure 1:
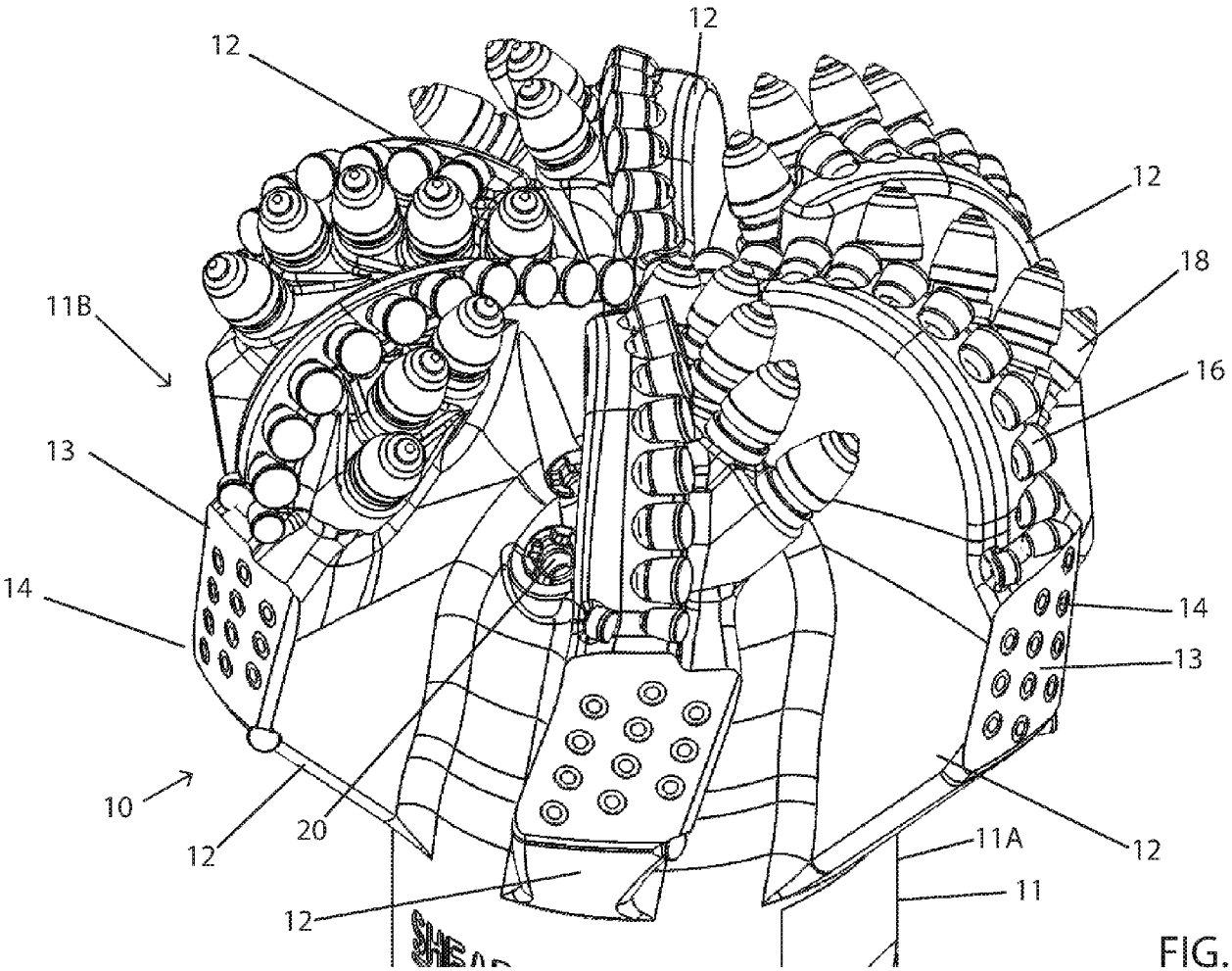
FIG. 1 is an oblique view on an example drill bit according to the present disclosure.

An example drill bit according to the present disclosure is shown in oblique view at 10 in FIG. 1. The bit 10 may include a bit body 11 having a tool joint section 11A for coupling the bit body 11 to a drill string (not shown) and a cutting section 11B which may include a plurality of circumferentially spaced apart blades 12. The bit body 11 may be formed from steel and have an abrasion resistant coating such as tungsten carbide applied to certain wear susceptible areas (not shown) on the bit body 11. Each of the blades 12 may extend from a selected distance proximate the axial center of the bit body 11, radially outwardly to a gage portion 13 having a diameter approximately equal to the diameter of a wellbore to be drilled by the bit 10. The gage portion 13 of each blade 12 may include gage inserts 14 made, for example, from a hard or superhard material such as polycrystalline diamond, cubic boron nitride, diamond impregnated tungsten carbide or tungsten carbide. The present example includes six, circumferentially equally spaced apart blades 12, but the number of blades and the circumferential spacing therebetween are not limits on the scope of the present disclosure.

At least one or each blade 12 may define a stepped, dual "profile" or curved shape. In the present example, a forward (with respect to direction of rotation of the bit) step of at least one or all of the blades 12 may be longitudinally lower or behind (further back or rearward with respect to the direction the bit will drill) than a rearward step of blade 12, as will be further explained below with reference to FIG. 2. Lower in the present context means further from the drilling surface defined by the profile of the blades 12. The forward step of the profile may include a plurality of pick type or gouging cutters 18 spaced in a row along the forward step. The gouging type cutters 18 will be further explained below. The rearward step of the profile may in some examples include a plurality of shear cutters 16, such as, for example, polycrystalline diamond compact (PDC) cutters, tungsten carbide cutters, or cubic boron nitride cutters of any type known in the art.

The shear cutters 16 may be mounted on the blade 12 at a selected backrake angle. In the present example, the backrake angle may be about 20 degrees with respect to a plane parallel to the axis of rotation of the bit. A range of backrake angles within about 10 to 30 degrees is within the scope of the present disclosure. The gouging cutters 18 may be mounted in openings (FIG. 2) such that they are at an angle of about 15 degrees to the same plane (equivalent to a forward rake angle of 15 degrees). A range of values for the foregoing angle of the gouging cutters of 15 to 45 degrees is within the scope of the present disclosure. In some examples, the tips (FIG. 4) of the gouging cutters 18 may extend longitudinally ahead of (in the direction the bit will drill) a cutting surface defined by the shear cutters 16 by about 0.5 inches (13 mm). A range of such extension between ⅛ inch (3 mm) and ¾ inch (19 mm) is within the scope of the present disclosure.

A space between circumferentially adjacent blades 12 may form a flow path or waterway to enable space for cuttings generated by the bit 10 to be disposed until they are forced out by the action of drilling fluid pumped through one or more nozzles or "jets" 20 inserted into the bit body 11 as shown in FIG. 1.

Figure 2:
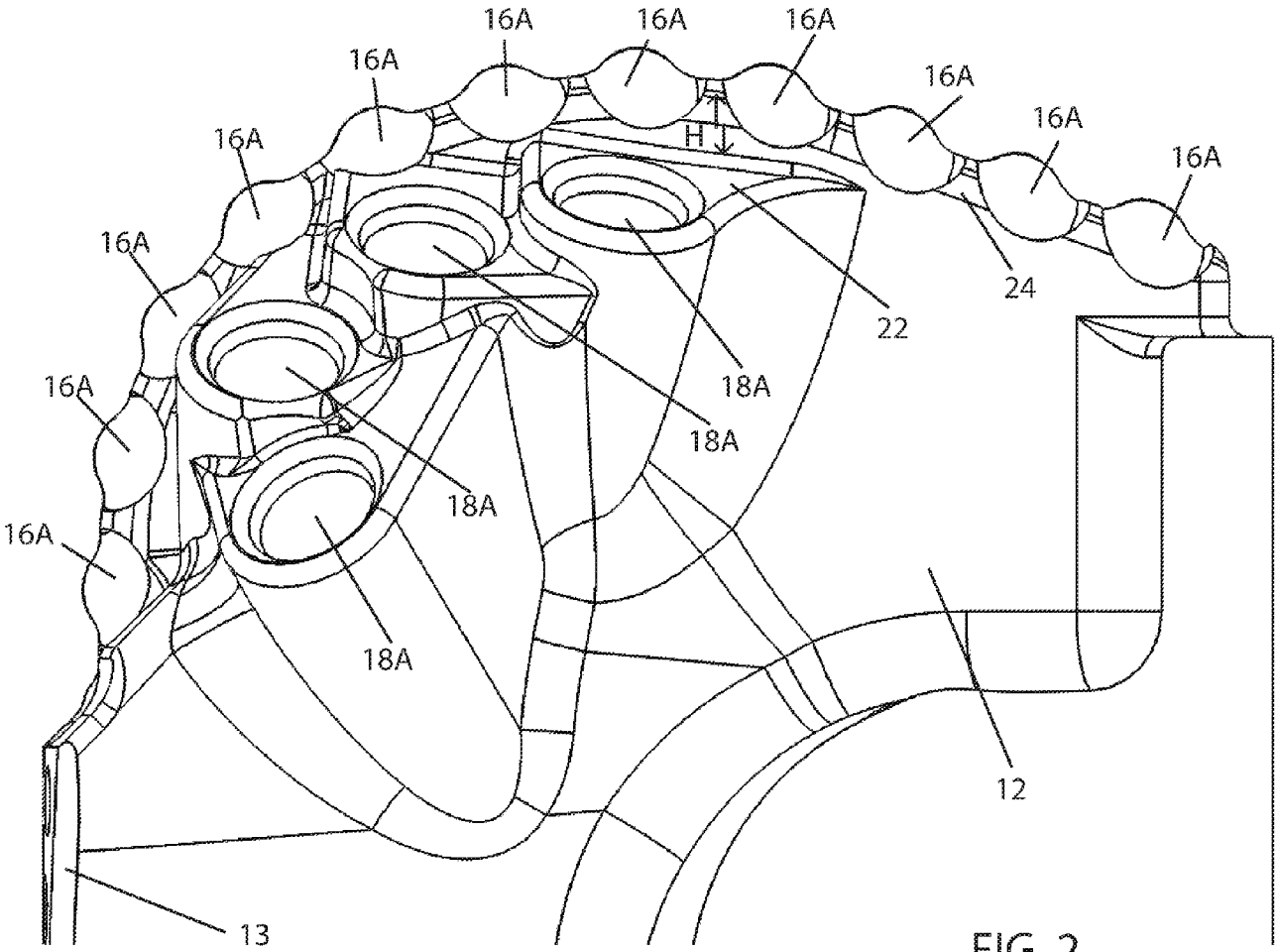
FIG. 2 shows a side view of an example blade of the bit shown in FIG. 1.

FIG. 2 shows a side view of one of the blades 12 without the cutters (16, 18 in FIG. 1) to better illustrate some of the blade's features. The blade 12 in the present example may define a forward (with respect to direction of rotation of the bit) step 22 that traverses a curved profile. The forward step 22 may extend radially inwardly to a predetermined position (i.e., a selected distance from the center of rotation of the bit body) enabling convenience of placement of the gouging cutters (18 in FIG. 1) in substantially cylindrically shaped pockets 18A. The curvature of the profile may substantially match the curvature of a corresponding portion of a rearward step 24 on the blade 12, or may have a different curvature. The rearward step 24 may be elevated (or extended longitudinally in the direction of drilling) by a selected distance H at one or more lateral positions along the blade 12. In the present example, the distance H may be about 0.5 inches (13 mm). The rearward step 24 may define a profile that extends radially outward to the gage surface 13 and may extend radially inward to a selected distance from the axis of rotation of the bit body (11 in FIG. 1) somewhat more than the forward step 22. The rearward step 24 shown in FIG. 2 may in some examples include pockets 16A for mounting the shear cutters (16 in FIG. 1). The curvature of the profile defined by the rearward step 24 may be any profile known to be used with fixed shear cutter drill bits. The distance by which the tips of the gouging cutters (18 in FIG. 1) extend beyond the rearward step 24 or a cutting surface defined by the shear cutters (16 in FIG. 1), if used, will be related to the length of the gouging cutters (18 in FIG. 1) and the selected distance H.

In the present example drill bit, shear cutters are used, as shown in FIG. 1. In the present example, the gouging cutters (18 in FIG. 1) are arranged so that they extend longitudinally (in the direction of drilling) beyond a cutting surface defined by the shear cutters (16 in FIG. 1) by about 0.5 inches (13 mm). A possible range of such extension may be ⅛ inch (3 mm) to ¾ inches (19 mm). The gouging cutters in the present example may be arranged in a row along the blades that is rotationally "ahead" (in the direction of rotation of the bit during drilling) of a row of the shear cutters by a selected distance. In the present example embodiment, at least one row of gouging type cutters may have at most three gouging cutters 18. In some embodiments, at least one row of gouging cutters may have at most four gouging cutters.

In other examples, the rearward step 24 may omit the mounting pockets 16A and the shear cutters (16 in FIG. 1) and perform the function of a depth of cut limiter for the gouging type cutters (18 in FIG. 1). In some examples, the tips (FIG. 4) of the gouging cutters (18 in FIG. 1) may extend beyond the surface of the rearward step 24 by about 0.5 inches (13 mm). A range of such extension between about ⅛ inch (3 mm) and ¾ inch (19 mm) is within the scope of the present disclosure.

In some examples, the blades (12 in FIG. 1) may only include a single profile surface that extends a selected distance from the rotational axis of the bit to the gage surface (13 in FIG. 1) and the gouging cutters (18 in FIG. 1) are mounted to the bit body (11 in FIG. 1) so that the tips thereof are disposed at a selected longitudinal distance ahead of the blade profile surface.

Figure 3:
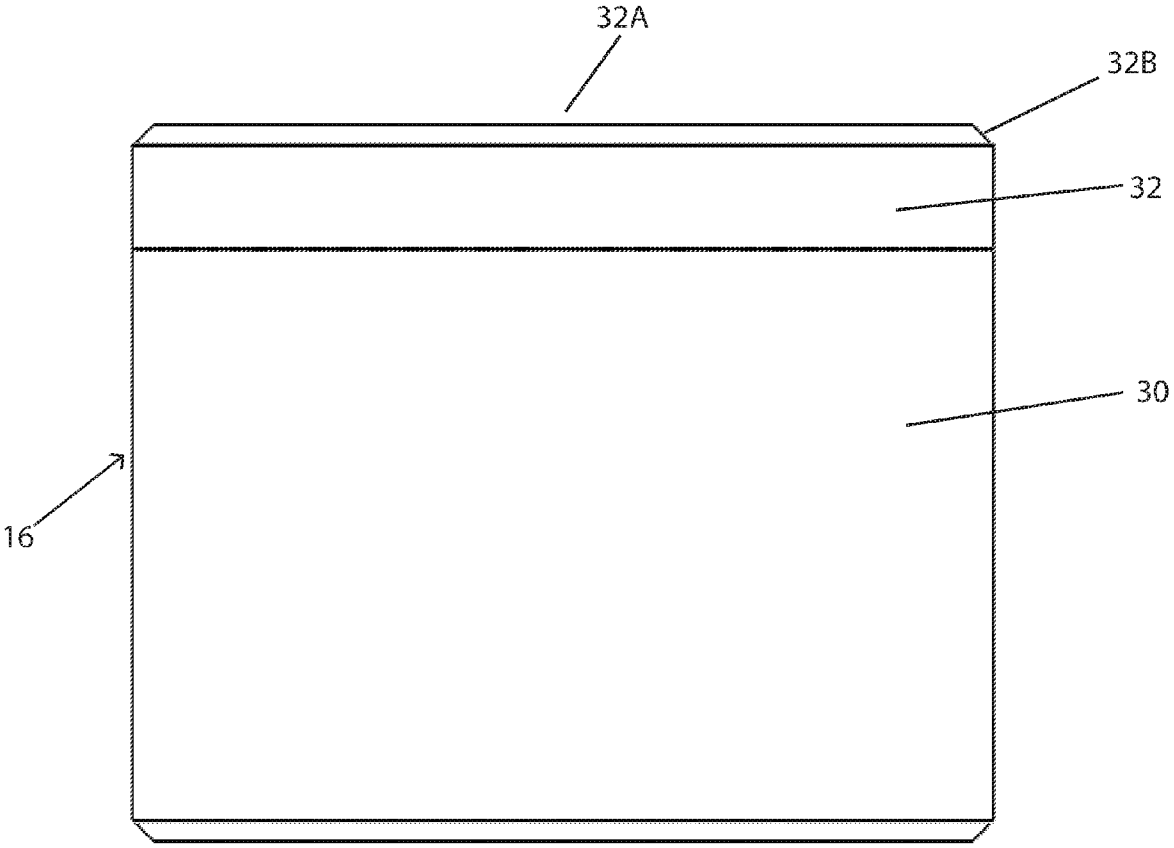
FIG. 3 shows one example of a shear cutter.

An example shear cutter 16 is shown in side view in FIG. 3. The example shown in FIG. 3 is a PDC cutter, although other types of shear cutters may be used in other implementations of a bit according to the disclosure. The shear cutter 16 may include a substrate 30 such as may be made from tungsten carbide or other material known in the art for such use in PDC cutters. A diamond table 32 may be affixed to an upper surface of the substrate 30. The diamond table 32 may be made from polycrystalline diamond using processes known in the art. Any known configuration of interface between the diamond table 32 and the substrate 30 may be used. The diamond table may have an exposed substantially planar surface 32A, which may have a chamfer 32B at its edge. The substrate 30 may be brazed to the bit body (11 in FIG. 1) on one of the pockets (16A in FIG. 2) using techniques known in the art. In other examples, the shear cutters 16 may be made from materials such as tungsten carbide, diamond impregnated tungsten carbide or cubic boron nitride.

Figure 4:
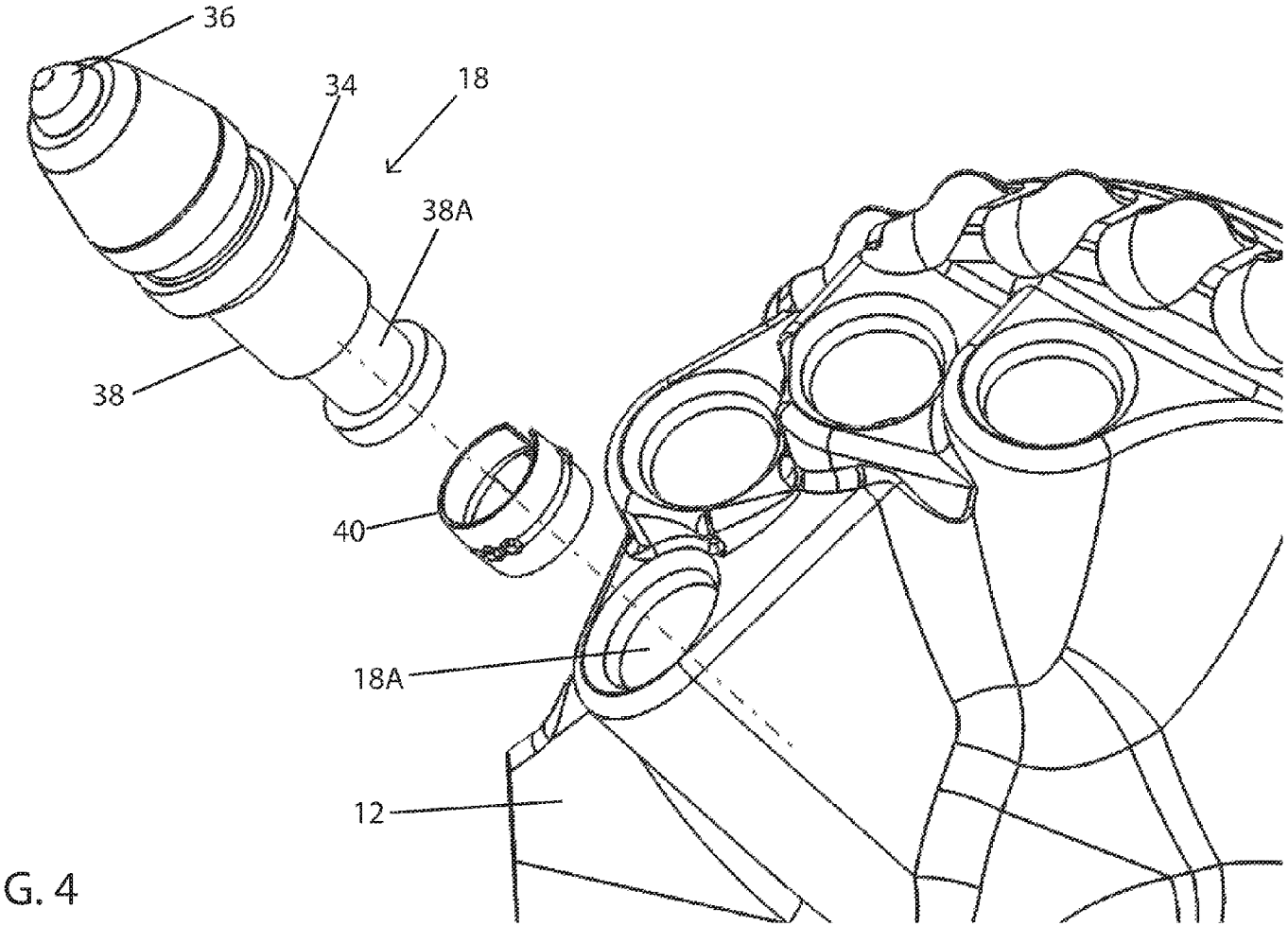
FIG. 4 shows one example of a gouging or gouging cutter.

FIG. 4 shows an exploded view of one of the gouging cutters 18 as it would be mounted in one of the pockets 18A in a blade 12. The gouging cutters 18 may include a substantially circular cross section cutter body 34 made from steel or similar high strength metal. The cutter body 34 may include a mounting post 38 which may have a same or smaller diameter than the cutter body 34, and be of such diameter as to enable free rotation of the cutter 18 when the mounting post 38 is inserted into the pocket 18A. The mounting post 38 may include a reduced diameter recess 38A in which may be disposed a snap ring 40 to lock the mounting post 38 within the pocket 18A longitudinally. Other forms of mounting the gouging cutters to the bit body will occur to those skilled in the art, it only being desirable to mount them as explained below. The mounting post 38 and the length of the cutter body 34 may be selected so that when mounted in the pocket 18A, in some embodiments the gouging cutter extends about 0.5 inches (13 mm) beyond a cutting surface defined by the shear cutters or the rearward step of the blade (24 in FIG. 2). A range of such extension between ⅛ inch (3 mm) and ¾ inch (19 mm) is within the scope of the present disclosure.

The cutter body 34 may taper toward a cutter tip 36. The cutter tip 36 may be substantially ballistically shaped and made from a hard or superhard material, e.g., tungsten carbide, diamond impregnated tungsten carbide, cubic boron nitride, polycrystalline diamond or other hard or superhard material. The gouging cutter 18 may be removed from the pocket 18A at any convenient location, where the bit (10 in FIG. 1) is being used, for example. The gouging cutters may be removed with common hand tools, so that in the event one or more of the gouging cutters 18 breaks during drilling, the bit may be repaired at the drilling site by replacement of the broken gouging cutter(s).

Figure 5:
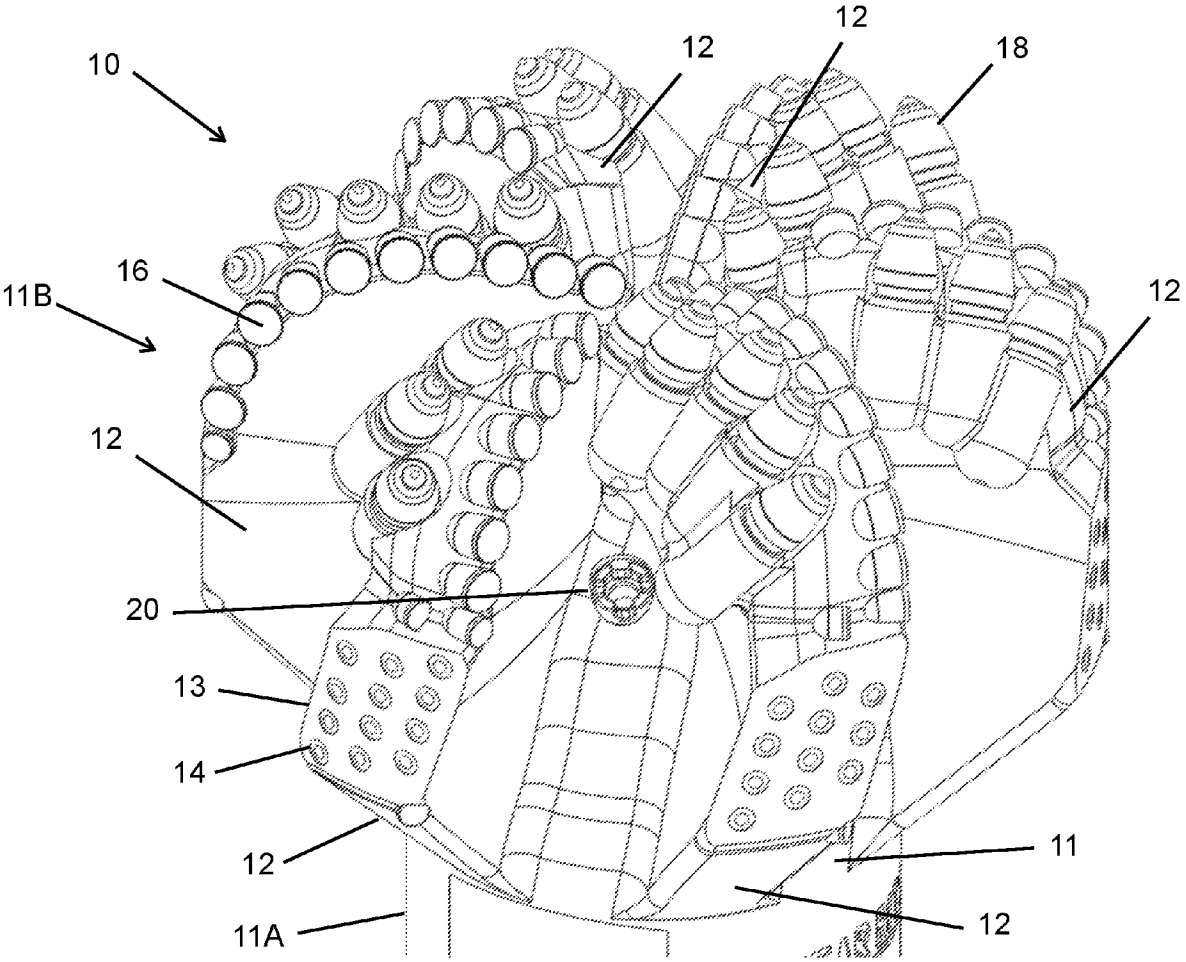
FIG. 5 shows another example of a drill bit according to the present disclosure.

FIG. 5 shows another example of a drill bit according to the present disclosure in which the gouging cutters 18 are mounted to the bit body 11 so as to be disposed rotationally behind the shear cutters 16. In the example of FIG. 5, the tips of the gouging cutters 18 may extend a selected distance beyond a cutting surface defined by the shear cutters 16.

Figure 6:
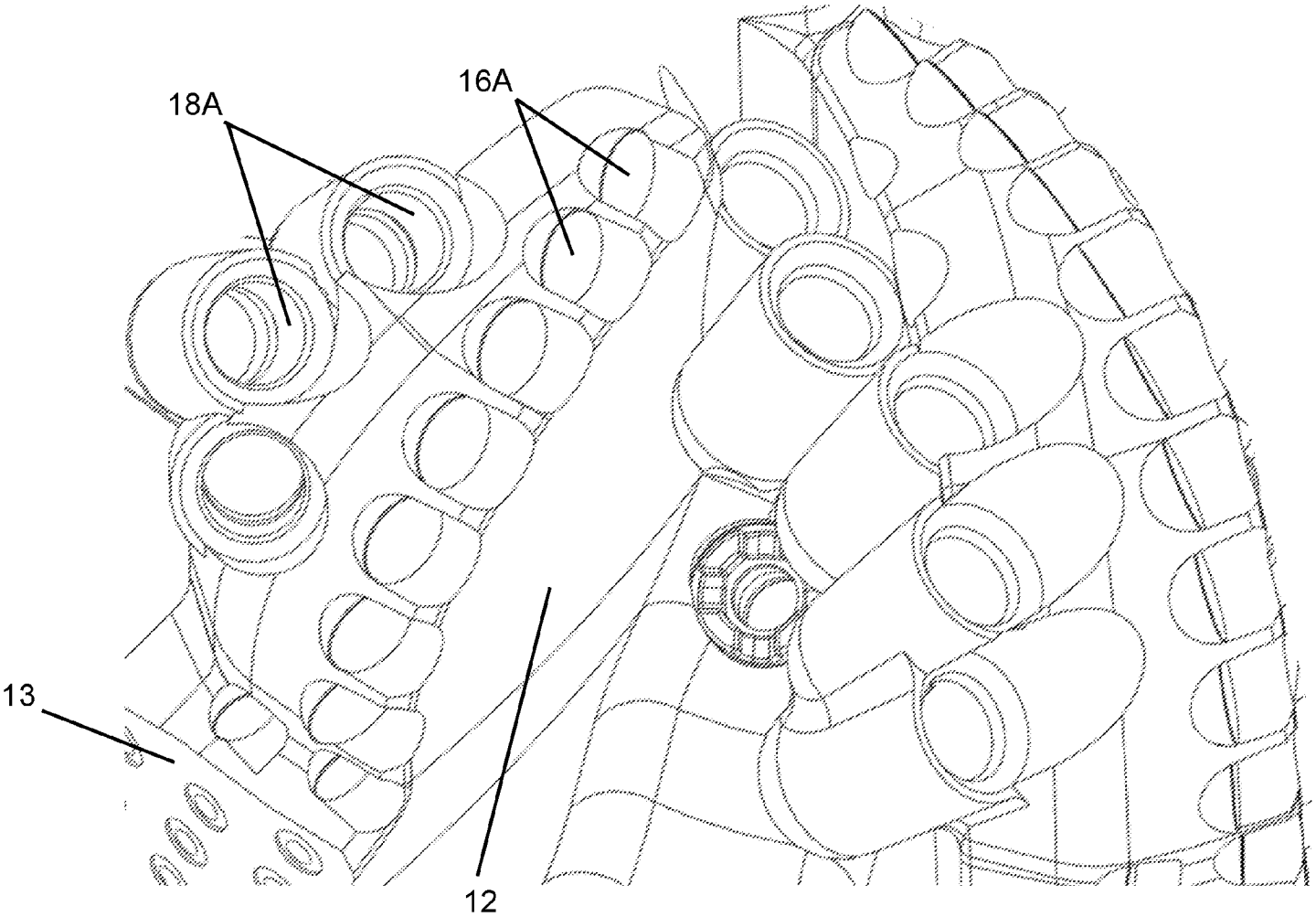
FIG. 6 shows an oblique view of blades according to the example bit shown in FIG. 5.

FIG. 6 shows an enlarged view of the bit body of FIG. 5 wherein pockets 16A for the shear cutters (16 in FIG. 5) are disposed at locations along the blade 12, and the pockets 18A for the gouging cutters (18 in FIG. 5 are shown disposed rotationally behind the blade 12. In the example of FIG. 6, the tips of the gouging cutters (18 in FIG. 5) may extend a selected longitudinal distance ahead of the cutting surface defined by the shear cutters (16 in FIG. 5) when mounted in the pockets 18A.

Figure 7:
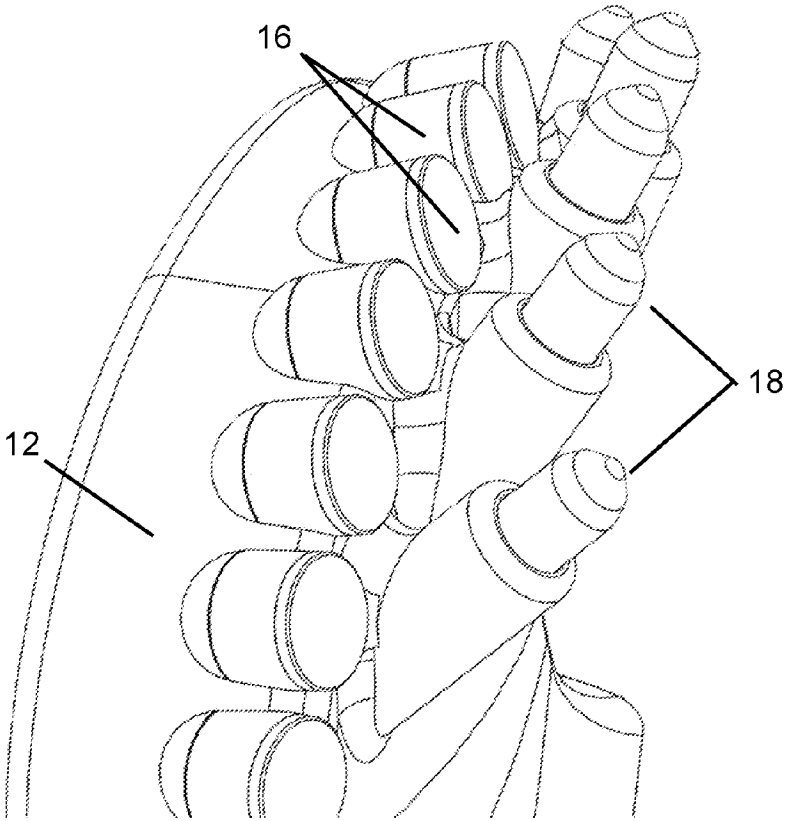
FIG. 7 shows an example blade having shear cutters with gouging cutters disposed rotationally ahead of the shear cutters.

FIG. 7 shows another example wherein the blade 12 only comprises mounting for the shear cutters 16. The gouging cutters 18 may be mounted rotationally ahead of the shear cutters 16 in pockets that are not on the blade top. In the example of FIG. 7, the tips of the gouging cutters 18 may extend a selected longitudinal distance ahead of the cutting surface defined by the shear cutters 16.

Figure 8:
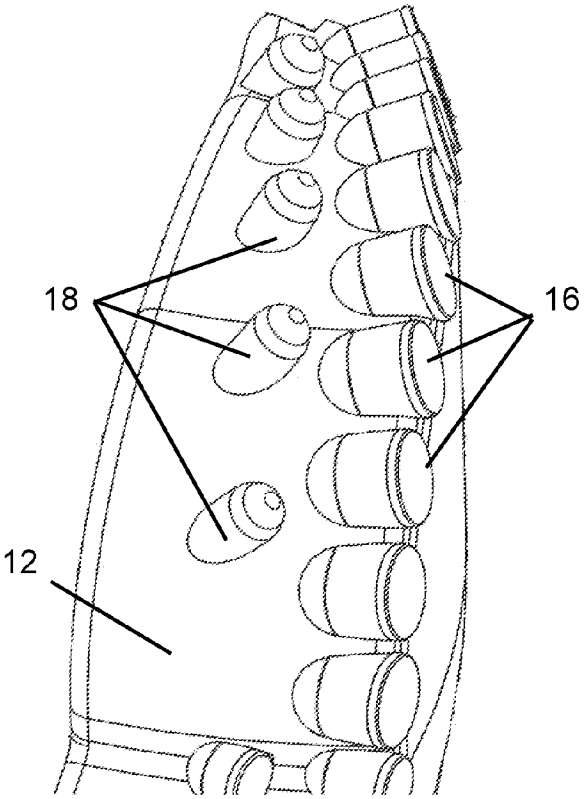
FIG. 8 shows an example blade having gouging cutters disposed rotationally behind gouging cutters.

FIG. 8 shows another example wherein at least one of the blades 12 includes gouging cutters 18 mounted therein and shear cutters 16 mounted on the blade 12 rotationally ahead of the gouging cutters 18. The tips of the gouging cutters 18 may extend a selected distance longitudinally ahead of a cutting surface defined by the shear cutters 16.

In other examples, gouging cutters may be mounted on one or more blades and shear cutters may be mounted on one or more blades. In such examples, as in the other examples described above, the gouging cutters and shear cutters may be affixed to the blades within the stated respective ranges of rake angles, and the gouging cutters may extend longitudinally ahead of the cutting surface defined by the shear cutters by the distances described above.

In the examples of FIGS. 5 through 8, the gouging cutters and shear cutters may have rake angles, structures and compositions substantially as set forth with reference to the examples described with reference to FIGS. 1 through 4.

Drill bits made according to the present disclosure have demonstrated ability to drill through vary coarse, unconsolidated sediments, with rock fragments in the centimeter size range, substantially without failure of either the gouging cutters or the shear cutters.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit, comprising:

a bit body having a plurality of gouging cutters mounted on the bit body;

a plurality of blades extending from a selected distance from an axis of rotation of the bit body to a gage face; and at least one of the plurality of blades comprising a plurality of shear cutters affixed thereon, wherein the gouging cutters extend a selected distance longitudinally ahead of a cutting surface defined by the shear cutters and wherein the gouging cutters are rotatably mounted to the bit body rotationally ahead of the shear cutters and in pockets that are on a leading face of a same one of the at least one of the plurality of blades.

2. The bit of claim 1 wherein the shear cutters comprise at least one of polycrystalline diamond compact cutters, tungsten carbide cutters, diamond impregnated tungsten carbide cutters and cubic boron nitride cutters.

3. The bit of claim 1 wherein the shear cutters are disposed at a backrake angle in a range of 10 to 30 degrees.

4. The bit of claim 1 wherein the shear cutters are disposed at a backrake angle of about 20 degrees.

5. The bit of claim 1 wherein the selected longitudinal extension of the gouging cutters is within a range of ⅛ inch (3 millimeters) to ¾ inch (19 millimeters) beyond the defined cutting surface.

6. The bit of claim 5 wherein the selected longitudinal extension of the gouging cutters is about 0.5 inches (13 millimeters) beyond the defined cutting surface.

7. The bit of claim 5 wherein the cutting tip is made from at least one of tungsten carbide, diamond impregnated tungsten carbide, cubic boron nitride, polycrystalline diamond.

8. The bit of claim 1 wherein the gouging cutters comprise a steel body and a tip made from at least one of tungsten carbide, diamond impregnated tungsten carbide, polycrystalline diamond and cubic boron nitride.

9. The bit of claim 1 wherein the gouging cutters are disposed at a forward rake angle in a range of 15 to 45 degrees.

10. The bit of claim 9 wherein the forward rake angle of the gouging cutters is about 15 degrees.

11. The bit of claim 1 further comprising at least one gage insert in the gage face of each of the blades.

12. The bit of claim 11 wherein the gage inserts comprise at least one of polycrystalline diamond, cubic boron nitride, diamond impregnated tungsten carbide and tungsten carbide.

13. The bit of claim 1 wherein the gouging cutters are removably mounted on the bit body.

14. The bit of claim 13 wherein each of the gouging cutters is locked into the bit body by a snap ring.

15. The bit of claim 1 wherein at least one of the gouging cutters comprises a cutter body, a mounting post at one end of the cutter body and a cutting tip at an opposed end of the cutter body.

16. The bit of claim 15 wherein the cutting tip is ballistically shaped.

17. The bit of claim 1 wherein the gouging cutters are mounted in at least one row having at most four gouging cutters along the at least one row.

18. The bit of claim 1 wherein the gouging cutters are mounted in at least one row having at most three gouging cutters along the at least one row.

19. A drill bit, comprising: a bit body having a plurality of gouging cutters mounted on the bit body; a plurality of blades extending from a selected distance from an axis of rotation of the bit body to a gage face; and at least one of the plurality of blades comprising a plurality of shear cutters affixed thereon, wherein the gouging cutters are rotatably mounted to the bit body rotationally ahead of the shear cutters and in pockets that are on a leading face of a same one of the at least one of the blades.

20. The bit of claim 19 wherein the gouging cutters are removably mounted on the bit body.

21. The bit of claim 20 wherein each of the gouging cutters is locked into the bit body by a snap ring.

22. The bit of claim 19 wherein at least one of the gouging cutters comprises a cutter body, a mounting post at one end of the cutter body and a cutting tip at an opposed end of the cutter body.

23. The bit of claim 22 wherein the cutting tip is ballistically shaped.

24. The bit of claim 22 wherein the cutting tip is made from at least one of tungsten carbide, diamond impregnated tungsten carbide, cubic boron nitride, polycrystalline diamond.

25. The bit of claim 19 wherein the gouging cutters are mounted in at least one row having at most four gouging cutters along the at least one row.

26. The bit of claim 19 wherein the gouging cutters are mounted in at least one row having at most three gouging cutters along the at least one row.

* * * * *